US011715420B2

(12) United States Patent
Kawachi

(10) Patent No.: US 11,715,420 B2
(45) Date of Patent: Aug. 1, 2023

(54) DISPLAY DEVICE

(71) Applicant: WUHAN TIANMA MICRO-ELECTRONICS CO., LTD., Wuhan (CN)

(72) Inventor: Genshiro Kawachi, Kanagawa (JP)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 17/341,752

(22) Filed: Jun. 8, 2021

(65) Prior Publication Data

US 2021/0383755 A1 Dec. 9, 2021

(30) Foreign Application Priority Data

Jun. 9, 2020 (JP) ..... 2020-100390

(51) Int. Cl.
*G09G 3/3233* (2016.01)

(52) U.S. Cl.
CPC ..... *G09G 3/3233* (2013.01); *G09G 2300/0809* (2013.01)

(58) Field of Classification Search
CPC ..... G09G 2300/0809; G09G 3/3233
See application file for complete search history.

(56) References Cited

U.S. PATENT DOCUMENTS

| | | | | |
|---|---|---|---|---|
| 10,962,818 | B1 * | 3/2021 | Campbell | G02F 1/133382 |
| 2005/0073632 | A1 * | 4/2005 | Dunn | G02F 1/133382 349/110 |
| 2005/0083443 | A1 * | 4/2005 | Lee | G02F 1/133382 349/21 |
| 2006/0082523 | A1 * | 4/2006 | Guo | G09G 3/3233 345/76 |
| 2012/0249516 | A1 * | 10/2012 | Wacyk | G09G 3/3233 345/212 |
| 2015/0138462 | A1 * | 5/2015 | Yang | G02F 1/136286 349/21 |
| 2016/0211308 | A1 * | 7/2016 | Lee | G09G 3/32 |
| 2018/0350891 | A1 * | 12/2018 | Kim | H01L 27/3276 |
| 2019/0378454 | A1 * | 12/2019 | Jin | G01K 1/026 |
| 2020/0126482 | A1 * | 4/2020 | Yang | G09G 3/3241 |
| 2020/0176608 | A1 * | 6/2020 | Yamazaki | H01L 27/0207 |
| 2020/0388225 | A1 * | 12/2020 | Kim | G06F 3/0418 |
| 2021/0005755 | A1 * | 1/2021 | Yamazaki | H01L 29/66969 |

FOREIGN PATENT DOCUMENTS

| | | |
|---|---|---|
| JP | 08211368 | 8/1996 |
| JP | 2005-321684 | 11/2005 |
| JP | 2007-081094 | 3/2007 |

* cited by examiner

*Primary Examiner* — Jeff Piziali
(74) *Attorney, Agent, or Firm* — Nixon & Vanderhye

(57) ABSTRACT

A display device includes a light-emitting element, a driving thin-film transistor configured to control the amount of electric current to the light-emitting element, and a heater electrode. The temperature of a channel of the driving thin-film transistor is higher than the temperature of an emission region of the light-emitting element when the heater electrode is generating heat.

17 Claims, 13 Drawing Sheets

TEMPERATURE DISTRIBUTION OF TFT IN LAYERING DIRECTION

TEMPERATURE DISTRIBUTION IN IN-PLANE DIRECTION

DISPLAY DEVICE

CROSS-REFERENCE TO RELATED APPLICATIONS

This non-provisional application claims priority under 35 U.S.C. § 119(a) on Patent Application No. 2020-100390 filed in Japan on Jun. 9, 2020, the entire content of which is hereby incorporated by reference.

BACKGROUND

This disclosure relates to a display device.

An organic light-emitting diode (OLED) element is a current-driven self-light-emitting element and therefore, does not need a backlight. In addition to this, the OLED element has advantages for achievement of low power consumption, wide viewing angle, and high contrast ratio; it is expected to contribute to development of flat panel display devices.

An active-matrix (AM) OLED display device includes transistors for selecting pixels and driving transistors for supplying electric current to the pixels. The transistors in an OLED display device are thin-film transistors (TFTs); particularly, low-temperature polysilicon (LTPS) TFTs or oxide semiconductor TFTs are used.

The TFTs have variations in their threshold voltage and charge mobility. Since the driving transistors determine the light emission intensity of the OLED display device, their variations in electrical characteristics could cause a problem. Hence, a typical OLED display device includes a correction circuit for compensating for the variations and shifts of the threshold voltage of the driving transistors.

SUMMARY

An aspect of this disclosure is a display device including: a light-emitting element; a driving thin-film transistor configured to control the amount of electric current to the light-emitting element; and a heater electrode. The temperature of a channel of the driving thin-film transistor is higher than the temperature of an emission region of the light-emitting element when the heater electrode is generating heat.

Another aspect of this disclosure is a display device including: a light-emitting element; a driving thin-film transistor configured to control the amount of electric current to the light-emitting element; and a heater electrode. At least a part of the heater electrode faces a gate electrode of the driving thin-film transistor across an insulator to function as a part of a storage capacitor that determines the potential of the gate electrode. At least a part of a channel of the driving thin-film transistor overlaps the heater electrode when viewed planarly.

It is to be understood that both the foregoing general description and the following detailed description are exemplary and explanatory and are not restrictive of this disclosure.

EMBODIMENTS

Figure 1:
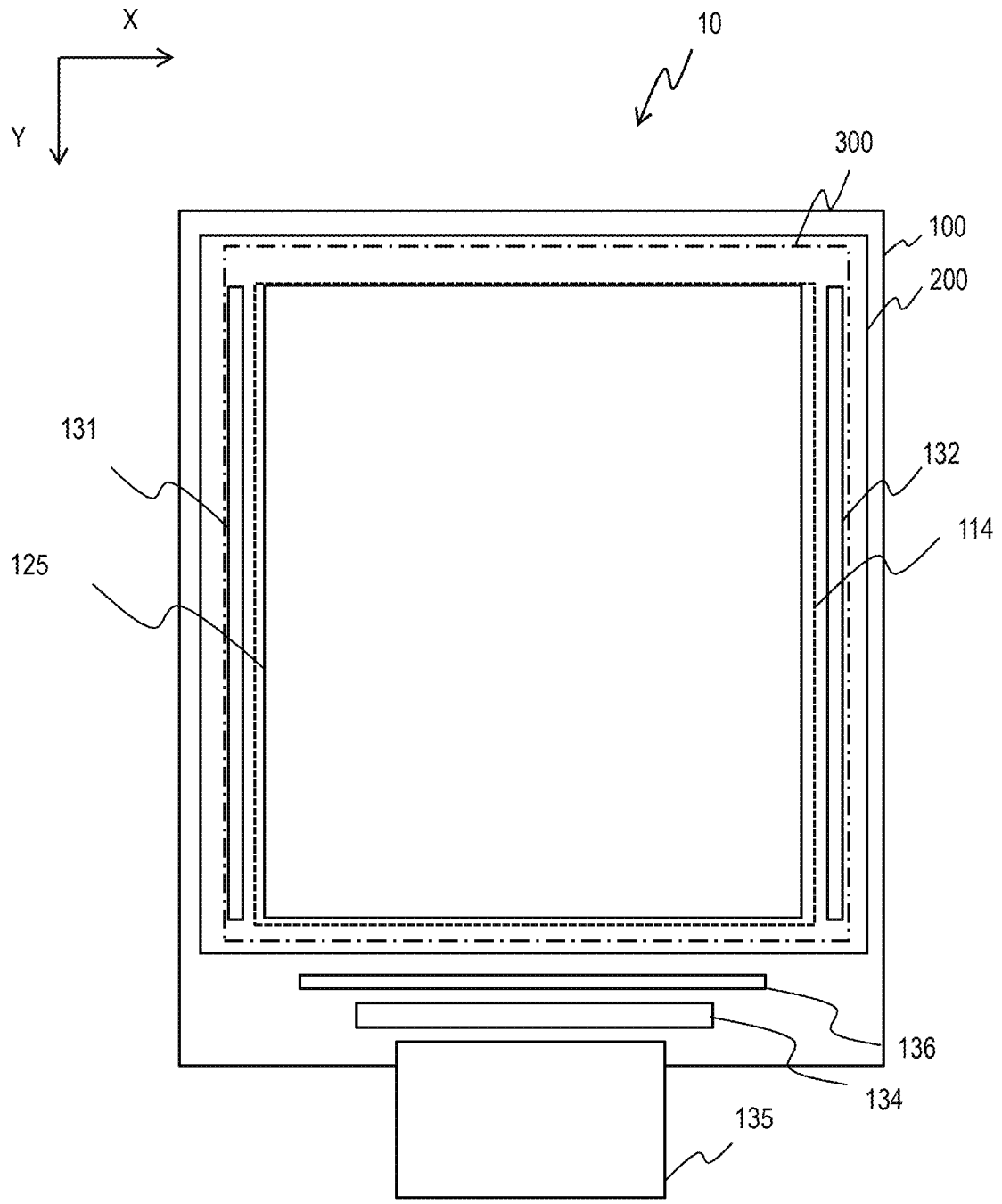
FIG. 1 schematically illustrates a configuration example of an OLED display device of a display device.

Hereinafter, embodiments will be described specifically with reference to the accompanying drawings. Elements common to the drawings are denoted by the same reference signs and each element in the drawings may be exaggerated in size and/or shape for clear understanding of the description.

Disclosed in the following is a technique to remedy the drift of driving current in a self-light-emitting display device utilizing light-emitting elements that emit light in response to the driving current, like an organic light-emitting diode (OLED) display device. The technique reduces the brightness change in the self-light-emitting display device.

A flexible OLED display device fabricated on a resin film, particularly a polyimide film, exhibits significant initial brightness change such that the brightness decreases by several percent in a few hours after activation. Comparative evaluation of thin-film transistors (TFTs) on a flexible substrate and TFTs on a glass substrate revealed that a large current drift occurs in the TFTs on a flexible substrate that keep receiving current bias, compared to the TFTs on a glass substrate. The inventor found that this current drift in driving TFTs causes initial brightness change to an OLED display device.

The embodiments in this description diminish the current drift of a driving TFT by heating the driving TFT with a heater electrode provided within the display region. The features of the embodiments in this description are applicable to self-light-emitting display devices of the kinds other than the OLED display device.

Configuration of Display Device

FIG. 1 schematically illustrates a configuration example of an OLED display device 10 of a display device. The OLED display device 10 includes a thin-film transistor (TFT) substrate 100 on which OLED elements (light-emitting elements) are provided, an encapsulation substrate 200 for encapsulating the OLED elements, and a bond (glass frit sealer) 300 for bonding the TFT substrate 100 with the encapsulation substrate 200. The space between the TFT substrate 100 and the encapsulation substrate 200 is filled with an inactive gas such as dry nitrogen and sealed up with the bond 300.

In the periphery of a cathode electrode region 114 outer than the display region (also called an active area) 125 of the TFT substrate 100, a scanning circuit 131, an emission control circuit 132, a driver IC 134, and a demultiplexer 136 are provided. The driver IC 134 is connected to the external devices via flexible printed circuits (FPC) 135. The scanning circuit 131 drives selection lines on the TFT substrate 100. The emission control circuit 132 drives emission control lines.

The driver IC 134 is mounted with an anisotropic conductive film (ACF), for example. The driver IC 134 provides power and timing signals (control signals) to the scanning circuit 131 and the emission control circuit 132 and further, provides a data signal to the demultiplexer 136.

The demultiplexer 136 outputs output of one pin of the driver IC 134 to d data lines in series (d is an integer more than 1). The demultiplexer 136 changes the output data line for the data signal from the driver IC 134 *d* times per scanning period to drive d times as many data lines as output pins of the driver IC 134.

The display region 125 includes a plurality of OLED elements (pixels) and a plurality of pixel circuits for controlling light emission of the plurality of pixels. In an example of a color OLED display device, each OLED element emits light in one of the colors of red, blue, and green. The plurality of pixel circuits constitute a pixel circuit array.

As will be described later, each pixel circuit includes a driving TFT (driving transistor) and a storage capacitor for storing signal voltage to determine the driving current of the driving TFT. The data signal transmitted by a data line is corrected and stored to the storage capacitor. The voltage of the storage capacitor determines the gate voltage (Vgs) of the driving TFT. The corrected data signal changes the conductance of the driving TFT in an analog manner to supply a forward bias current corresponding to the light emission level to the OLED element. The features of the embodiments are applicable to display devices with pixel circuits including no correction circuit.

Current Instability in TFT

Figure 2:
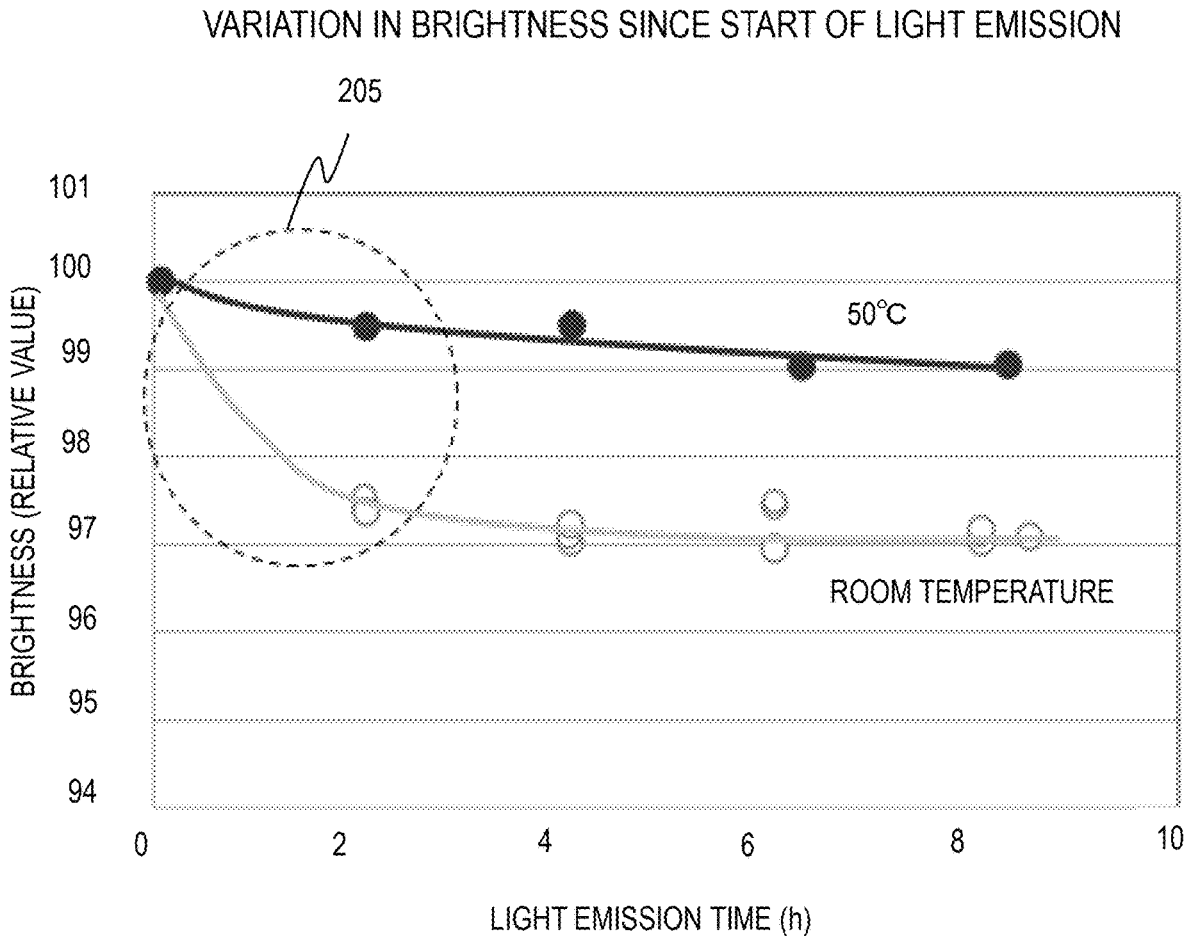
FIG. 2 provides measurement results to show the variation in brightness of an OLED display device on a polyimide substrate over time after activation.

The OLED display devices 10 in the embodiments of this description heat the driving TFTs to reduce the brightness change (initial brightness change) after their activation. FIG. 2 provides measurement results to show the variation in brightness of an OLED display device on a polyimide substrate over time after activation. Specifically, FIG. 2 provides temporal variation in relative brightness when the environmental temperature was 50° C. and temporal variation in relative brightness when the environmental temperature was room temperature. The X-axis represents the relative brightness and the Y-axis represents the time elapsed since activation.

As encircled by a broken line 205 in FIG. 2, the brightness of the OLED display device 10 drops in a few hours after activation. When the environmental temperature is 50° C., the initial brightness drop is small; however, when the environmental temperature is room temperature, the drop is large. The brightness after two hours from activation is lower than the brightness immediately after the activation by almost 3%. When a TFT on a polyimide substrate keeps receiving current bias, current drift occurs. This current drift causes initial brightness drop to the OLED display device.

Figure 3:
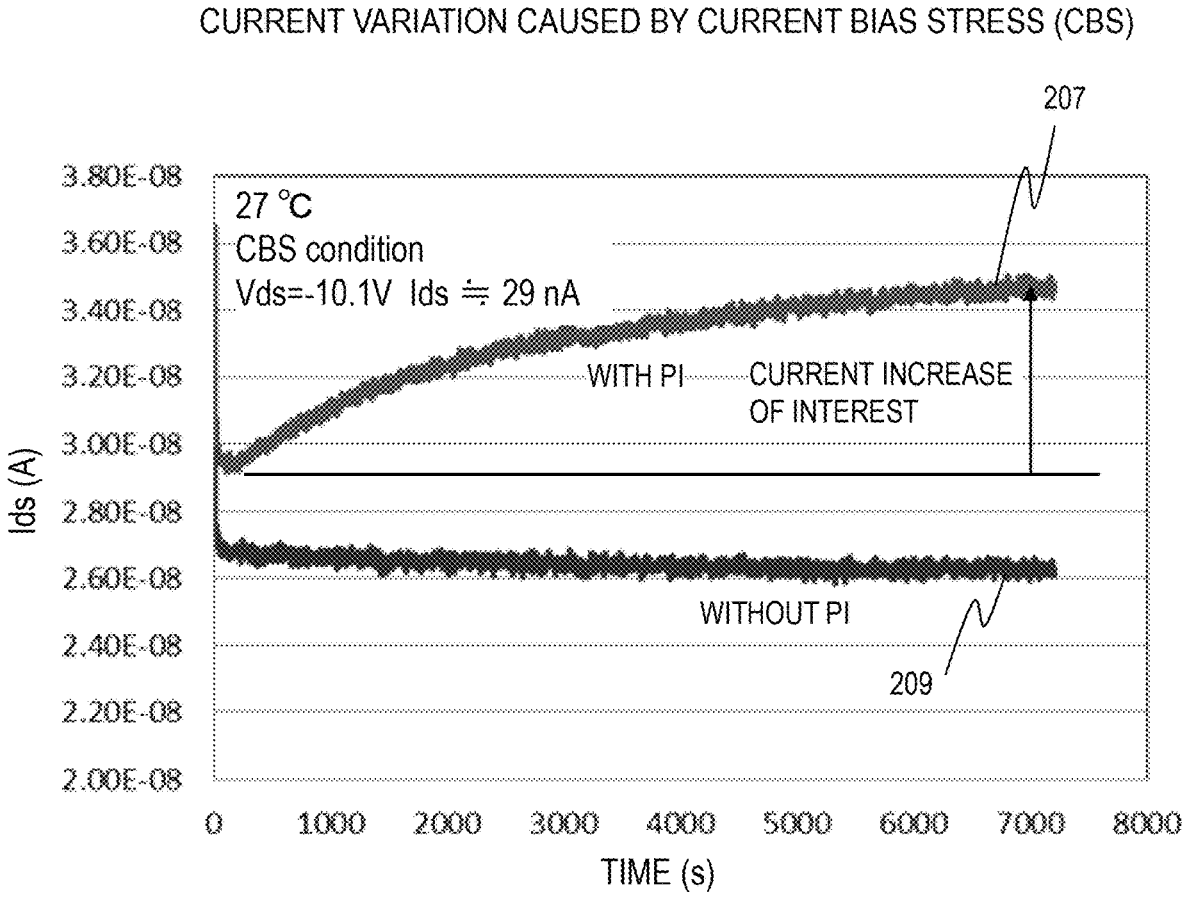
FIG. 3 provides measurement results to explain the variation in current of a TFT on a polyimide substrate caused by a current bias stress (CBS)

FIG. 3 provides measurement results to explain the variation in current of a TFT on a polyimide substrate caused by a current bias stress (CBS). Specifically, FIG. 3 provides current variation 207 of a TFT on a polyimide film provided on a glass substrate and current variation 209 of a TFT fabricated on a glass substrate with no polyimide film. The X-axis represents the time elapsed since supply of the current is started and the Y-axis represents the drain-source current Ids. The environmental temperature was 27° C. and the drain-source voltage Vds was −10.1 V. The drain-source current Ids when supply of the current was started was approximately 29 nA.

The TFT on a glass substrate with no polyimide film does not show significant change (instability) in the drain-source current Ids (the graph 209). However, the TFT on a polyimide layer shows significant increase in the drain-source current Ids.

As noted from these measurement results, when a polyimide layer is not provided under the TFT, the instability of the drain-source current (increase in Ids) is not observed. Accordingly, it is understood that the polyimide layer causes the instability of the current (increase in Ids) in a TFT. This is presumed to be because an electric field applied to a polyimide layer that has absorbed moisture induces negative charges in the polyimide film to shift the threshold voltage Vth of the TFT.

The correction circuit (Vth correction circuit) in a pixel circuit determines the gate-source voltage of the driving TFT corresponding to the video signal so that the variation in Vth of the driving TFT will be compensated for. The correction circuit corrects the shifted Vth in consideration of the increase in Ids current; therefore, the gate-source voltage of the driving TFT corresponding to the video signal is lowered and the current supplied to the OLED element decreases. As a result, the brightness of the OLED display device 10 drops. In fact, the simulation result of a pixel circuit including a correction circuit indicates that increase in the drain-source current of the driving TFT by 20% results in decrease in the driving current for the OLED element by approximately 2%.

The inventor's research revealed that the current instability can be diminished temporarily by heating the TFT to high temperature. Specifically, the current instability can be substantially eliminated on a temporary basis by heating the channel of the TFT to temperature 80° C. or higher. Meanwhile, the adverse effect of the heat from a heater electrode MCH onto the light emission of the OLED element can be prevented by maintaining the emission region of the OLED element at temperature of 70° C. or lower when the heater electrode MCH is radiating heat.

Figure 4:
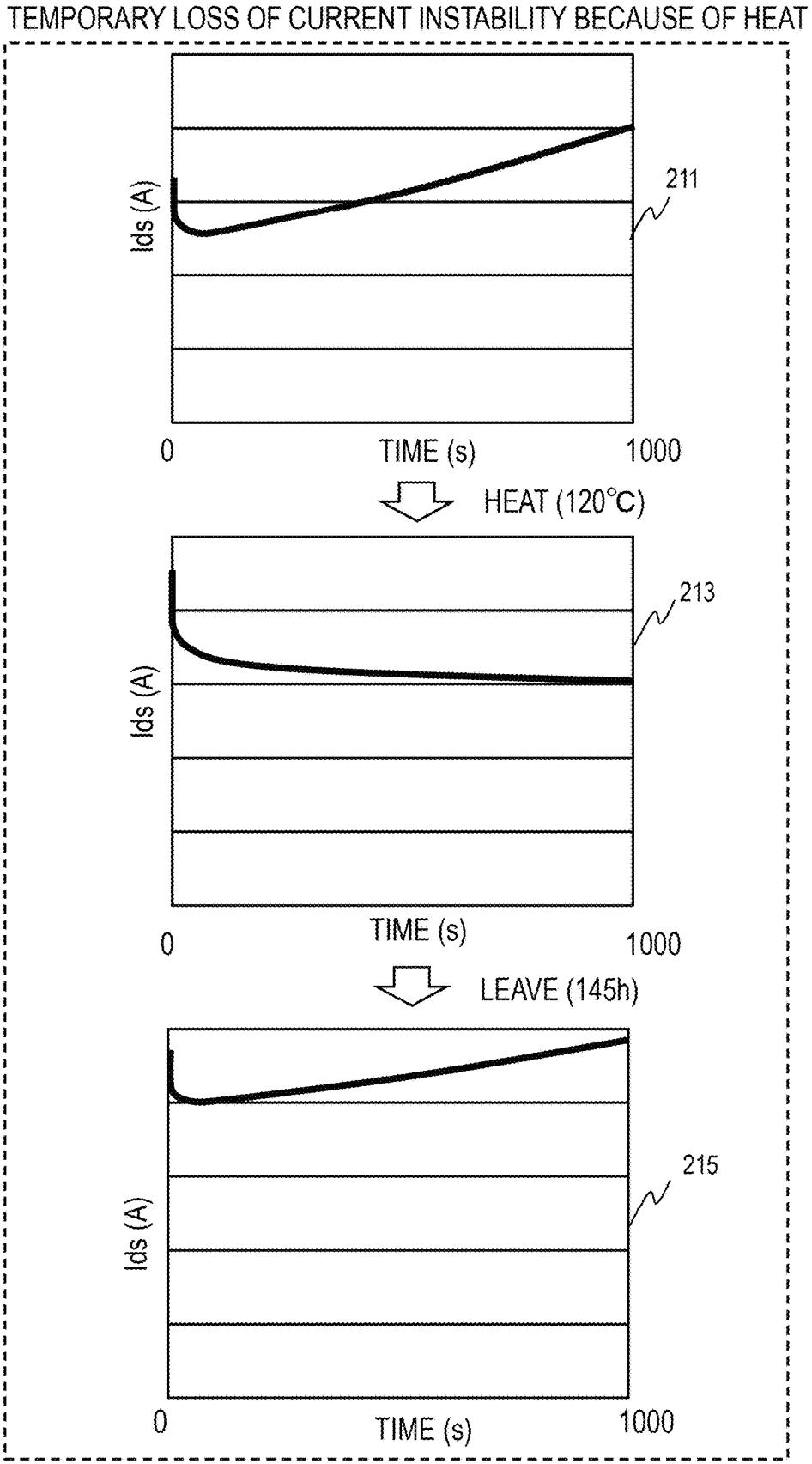
FIG. 4 is a chart indicating the relation between the temperature of a TFT and current instability.

FIG. 4 is a chart indicating the relation between the temperature of a TFT and the current instability. The graph 211 represents temporal variation in drain-source current of a TFT in the initial state before the TFT is heated. The graph 213 represents temporal variation in drain-source current of the TFT after the TFT is heated at 120° C. The graph 215 represents temporal variation in drain-source current of the TFT left for 145 hours after being heated.

As understood from the graph 213, the current instability can be eliminated by heating the TFT. However, as indicated by the graph 215, the current instability reappears when the TFT is left for some time after being heated. Accordingly, thermal aging in manufacturing an OLED display device 10 is not a sufficient solution to the current instability of the TFTs. It is important to incorporate a function to heat the driving TFTs into the OLED display device 10.

Wiring Layout of OLED Panel

Figure 5:
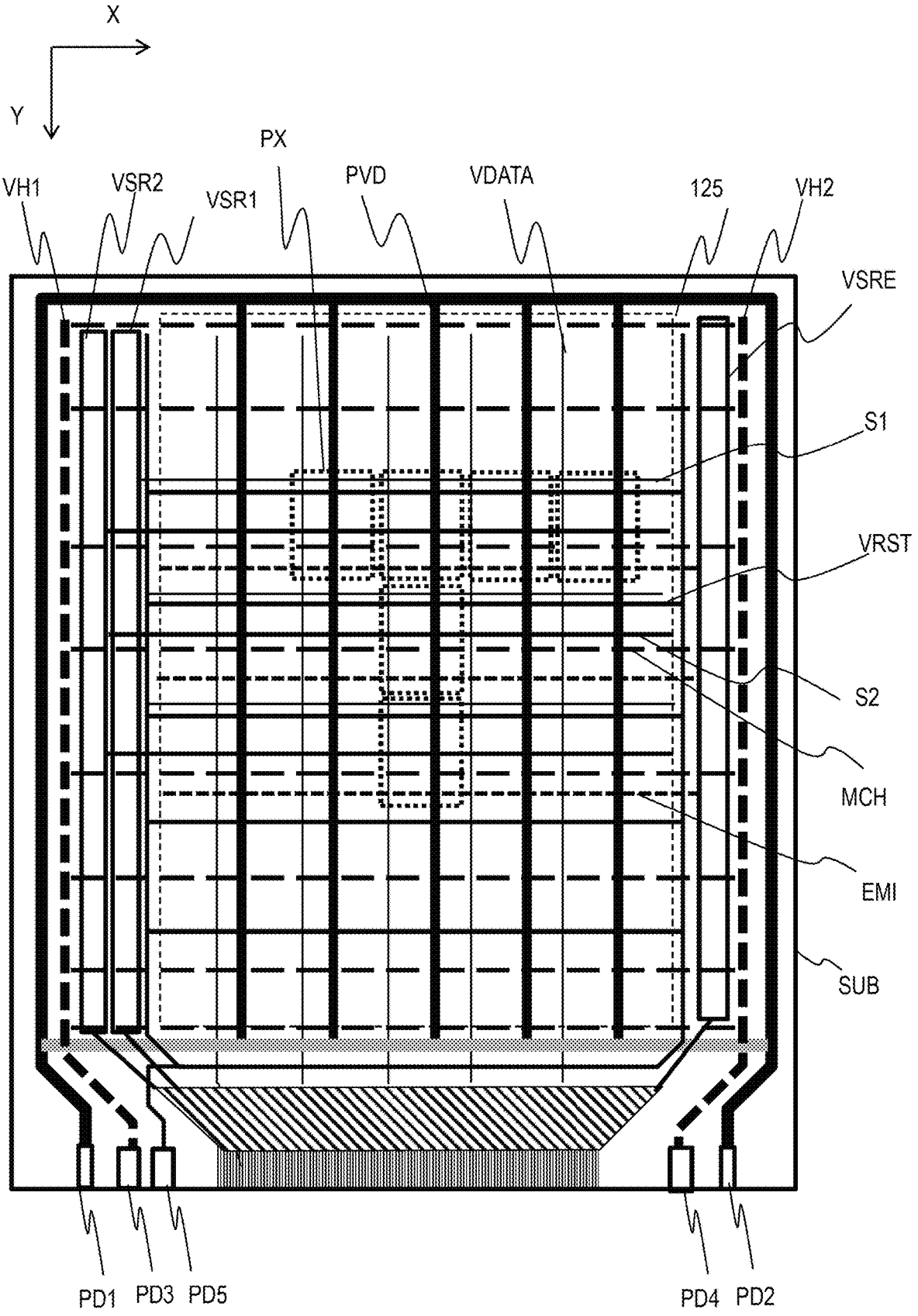
FIG. 5 illustrates an example of the wiring layout of a TFT substrate.

FIG. 5 illustrates an example of the wiring layout of the TFT substrate 100. The display region 125 is provided on a polyimide substrate SUB. The heating mechanism in this embodiment is applicable to not only display devices including a polyimide layer as a flexible substrate but also display devices including a polyimide layer between a glass substrate and driving transistors.

The display region 125 includes a plurality of pixels PX disposed in a matrix. Two shift registers VSR1 and VSR2 are provided outside, on the left side in FIG. 5, of the display region 125. These shift registers VSR1 and VSR2 are included in the scanning circuit 131. The shift register VSR1 selects selection lines S1 disposed to extend along the X-axis and to be one above another along the Y-axis one after another to supply a selection signal. The shift register VSR2 selects selection lines S2 disposed to extend along the X-axis and to be one above another along the Y-axis one after another to supply a selection signal.

A shift register VSRE is included in the emission control circuit 132. The shift register VSRE selects emission control lines EMI disposed to extend along the X-axis and to be one above another along the Y-axis one after another to supply an emission control signal.

The pattern of a power line PVD for supplying a power supply voltage to the pixel circuits includes a line surrounding the display region 125 and a plurality of lines disposed within the display region 125 to extend along the Y-axis and to be side by side along the X-axis. The power line PVD supplies a constant power supply potential to each of the pixel circuits. The constant power supply potential is supplied from the driver IC 134 to the power line PVD via connection pads PD1 and PD2.

A heating potential supply bus VH1 extends along the Y-axis on the left side of the display region 125. A heating potential supply bus VH2 extends along the Y-axis on the right side of the display region 125. A first heating potential is supplied from an external circuit to the heating potential supply bus VH1 via a connection pad PD3. A second heating potential different from the first heating potential is supplied to the heating potential supply bus VH2 from a connection pad PD4.

Heater electrodes MCH are disposed within the display region 125 between the heating potential supply buses VH1 and VH2 to extend along the X-axis and to be one above another along the Y-axis. Each heater electrode MCH is connected with the heating potential supply buses VH1 and VH2 and supplied with a heating power (heating current) determined by the voltage between the potentials of the heating potential supply buses VH1 and VH2. When the heating power is being supplied, each heater electrode MCH radiates heat to heat the driving TFTs in the pixel circuits associated therewith.

Data lines VDATA are disposed to extend along the Y-axis and to be side by side along the X-axis. The driver IC 134 supplies each data line VDATA with a data signal specifying the brightness of the selected OLED element (pixel or subpixel). Reset lines VRST are disposed to extend along the X-axis and to be one above another along the Y-axis. A constant reset potential is supplied from the driver IC 134 to the reset lines VRST through a connection pad PD5 and lines on the left and the right sides of the display region 125.

Pixel Circuit

Figure 6:
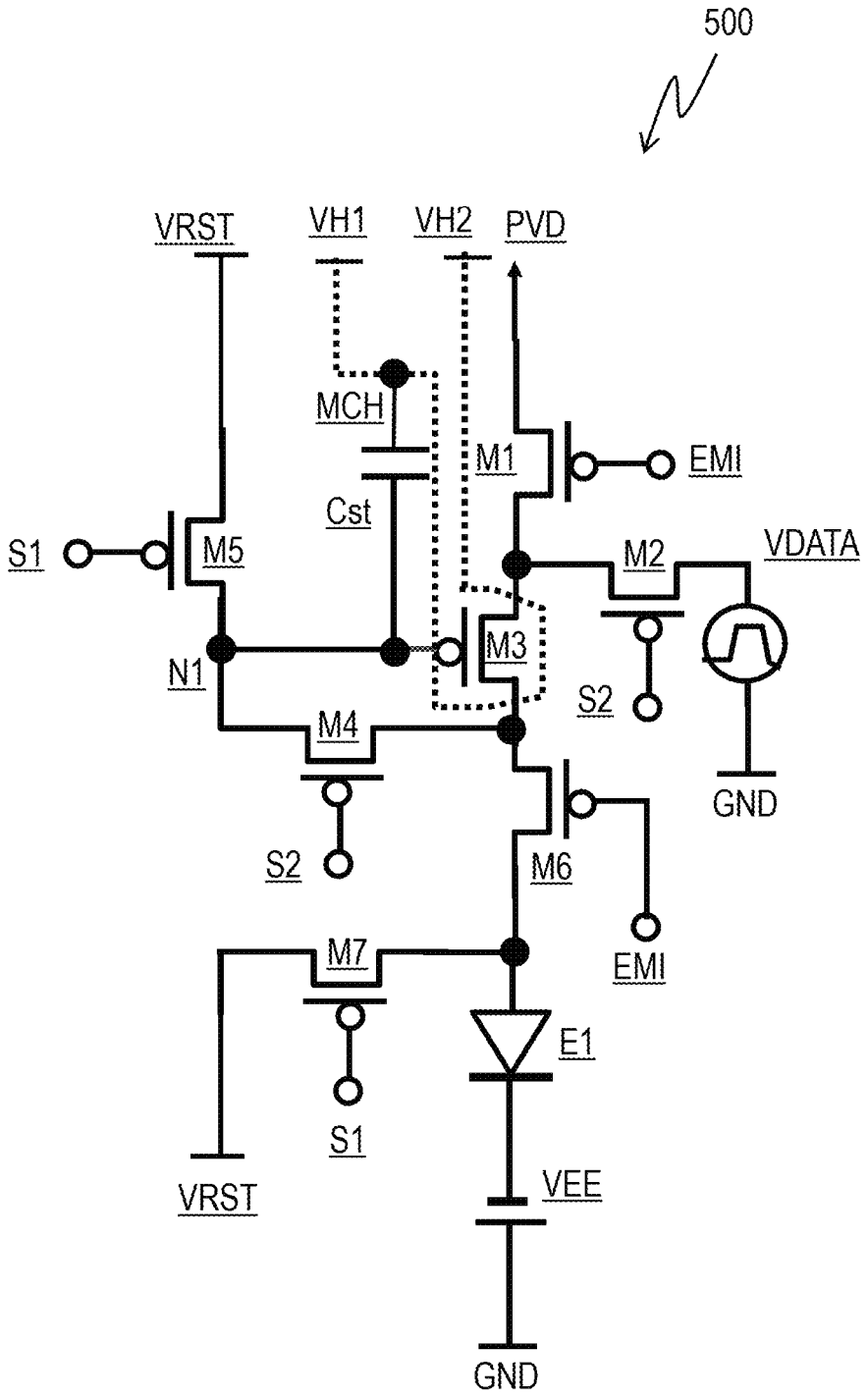
FIG. 6 illustrates a configuration example of a pixel circuit in an embodiment.

FIG. 6 illustrates a configuration example 500 of a pixel circuit in an embodiment. The pixel circuit 500 includes a heater electrode for heating the driving transistor. Heating the driving transistor M3 with the heat radiated from the heater electrode reduces the initial drop of the brightness after activation of the OLED display device 10. The heating mechanism is applicable to pixel circuits different from this example, inclusive of a pixel circuit that does not have a threshold voltage correction function.

The pixel circuit 500 corrects the data signal supplied from the driver IC 134 and controls the light emission of the OLED element with the corrected data signal. The pixel circuit 500 includes seven transistors (TFTs) M1 to M7 each having a gate, a source, and a drain. In this example, the transistors M1 to M7 are p-type TFTs. The heating mechanism in this embodiment is applicable to a pixel circuit including n-type semiconductor transistors or oxide semiconductor transistors.

The transistor M3 is a driving transistor for controlling the amount of current to an OLED element E1. The driving transistor M3 controls the amount of current to be supplied from a power line PVD to the OLED element E1 in accordance with the voltage stored in a storage capacitor Cst. The cathode of the OLED element E1 is connected with a cathode power line VEE. The storage capacitor Cst stores the gate-source voltage (also simply referred to as gate voltage) of the driving transistor M3.

The transistors M1 and M6 control whether to make the OLED element E1 emit light. The source of the transistor M1 is connected with the power line PVD to switch ON/OFF the current supply to the driving transistor M3 connected with the drain of the transistor M1. The source of the transistor M6 is connected with the drain of the driving transistor M3 to switch ON/OFF the current supply to the OLED element E1 connected with the drain of the transistor M6. The transistors M1 and M6 are controlled by an emission control signal input to their gates from an emission control line EMI.

The transistor M7 works to supply a reset potential to the anode of the OLED element E1. When the transistor M7 is turned ON by a selection signal from a selection line S1, the transistor M7 supplies a reset potential from a reset line VRST to the anode of the OLED element E1.

The transistor M5 controls whether to supply the reset potential to the gate of the driving transistor M3. When the transistor M5 is turned ON by the selection signal input from the selection line S1 to the gate, the transistor M5 supplies the reset potential from the reset line VRST to the gate of the driving transistor M3. The reset potential for the anode of the OLED element E1 can be different from the reset potential for the gate of the driving transistor M3.

The transistor M2 is a selection transistor for selecting the pixel circuit 500 to be supplied with a data signal. The gate potential of the transistor M2 is controlled by a selection signal supplied from a selection line S2. When the selection transistor M2 is ON, the selection transistor M2 supplies a data signal supplied through a data line VDATA to the gate (storage capacitor Cst) of the driving transistor M3.

In this example, the selection transistor M2 (the source and the drain thereof) is connected between the data line VDATA and the source of the driving transistor M3. Further, the transistor M4 is connected between the drain and the gate of the driving transistor M3.

The transistor M4 works to correct the threshold voltage of the driving transistor M3. When the transistor M4 is ON, the driving transistor M3 operates as a diode-connected transistor. The data signal from the data line VDATA is supplied to the storage capacitor Cst via the channels (the sources and the drains) of the selection transistor M2, the driving transistor M3, and the transistor M4 that are ON.

The storage capacitor Cst stores a data signal (gate-source voltage) corrected depending on the threshold voltage Vth of the driving transistor M3. In the example of FIG. 6, one of the electrodes of the storage capacitor Cst is connected with the gate of the driving transistor M3 and the other electrode is included in a heater electrode MCH. Utilizing one of the electrodes of the storage capacitor Cst as a heater electrode enables efficient incorporation of a mechanism for heating the driving transistor into the pixel circuit.

Figure 7:
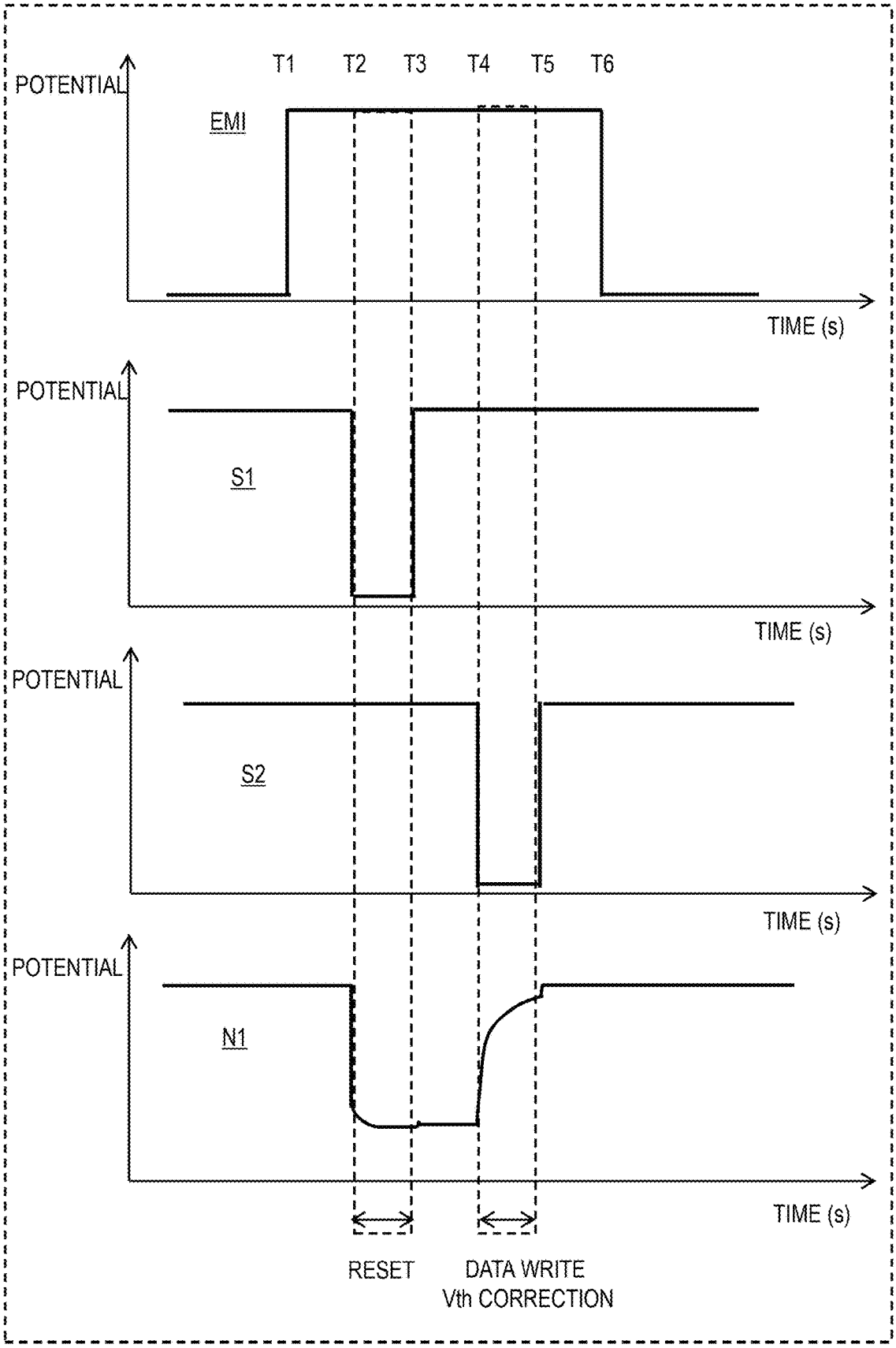
FIG. 7 is a timing chart of the signals for controlling the pixel circuit illustrated in FIG. 6 in one frame period.

FIG. 7 is a timing chart of the signals for controlling the pixel circuit 500 in FIG. 6 in one frame period. FIG. 7 is a timing chart to select the N-th row and write a data signal to the pixel circuit 500 in one frame period. Hereinafter, the signals are identified by the same reference signs as the lines for transmitting the signals for the simplicity of explanation. Specifically, FIG. 7 illustrates the variation of the signal (emission control signal EMI) on the emission control line EMI, the signal (selection signal S1) on the selection line S1, the signal (selection signal S2) on the selection line S2, and the potential at the node N1 shown in FIG. 6 during one frame period. The potential at the node N1 is equal to the gate potential of the driving transistor M3.

At a time T1, the emission control signal EMI changes from Low to High. In response to this change, the transistors M1 and M6 are turned OFF at the time T1. The selection signals S1 and S2 at the time T1 are High. In accordance with these signals, the transistors M2, M4, M5, and M7 are OFF. The states of these transistors are maintained until a time T2 later than the time T1. The potential at the node N1 is the signal potential of the previous frame.

At the time T2, the selection signal S1 changes from High to Low. The emission control signal EMI and the selection signal S2 at the time T2 are High. In response to the change of the selection signal S1, the transistors M5 and M7 are turned ON. The transistors M1, M2, M4 and M6 are OFF.

In response to the transistor M5 turning ON, the node potential N1 changes to the reset potential from the reset line VRST. The reset potential is supplied to the node N1 from the time T2 to a time T3. The potential at the node N1 becoming the reset potential in each frame makes the gate potential of the driving transistor become the same potential in each frame. In response to the transistor M7 turning ON, the reset potential is supplied from the reset line VRST to the anode of the OLED element E1.

At the time T3, the selection signal S1 changes from Low to High. The emission control signal EMI and the selection signal S2 at the time T3 are High. In response to the change of the selection signal S1, the transistors M5 and M7 are turned OFF. The transistors M1, M2, and M4 to M7 are OFF from the time T3 to a time T4.

At the time T4, the selection signal S2 changes from High to Low. The emission control signal EMI and the selection signal S1 at the time T4 are High. In response to the change of the selection signal S2, the transistors M2 and M4 are turned ON. The transistors M1, M5, M6, and M7 are OFF.

Since the transistor M4 is ON, the driving transistor M3 is diode-connected. Since the transistor M2 is ON, the data signal from the data line VDATA is written to the storage capacitor Cst via the transistors M2, M3, and M4.

The voltage to be written to the storage capacitor Cst is a voltage after the correction to the threshold voltage Vth of the driving transistor M3 is incorporated in the data signal. In the period from the time T4 to a time T5, data signal write to the pixel circuit 500 and Vth correction are performed.

At the time T5, the selection signal S2 changes from Low to High. The emission control signal EMI and the selection signal S1 at the time T5 are High. In response to the change of the selection signal S2, the transistors M2 and M4 are turned OFF. The transistors M1, M2, and M4 to M7 are OFF. These states of the control signals and the transistors are maintained from the time T5 to a time T6.

At the time T6, the emission control signal EMI changes from High to Low, so that the transistors M1 and M6 are turned ON. The selection signals S1 and S2 are High and accordingly, the transistors M2, M4, M5, and M7 are kept be OFF. The driving transistor M3 controls the driving current to be supplied to the OLED element E1 based on the corrected data signal stored in the storage capacitor Cst. This means that the OLED element E1 emits light.

Device Structure

Figure 8:
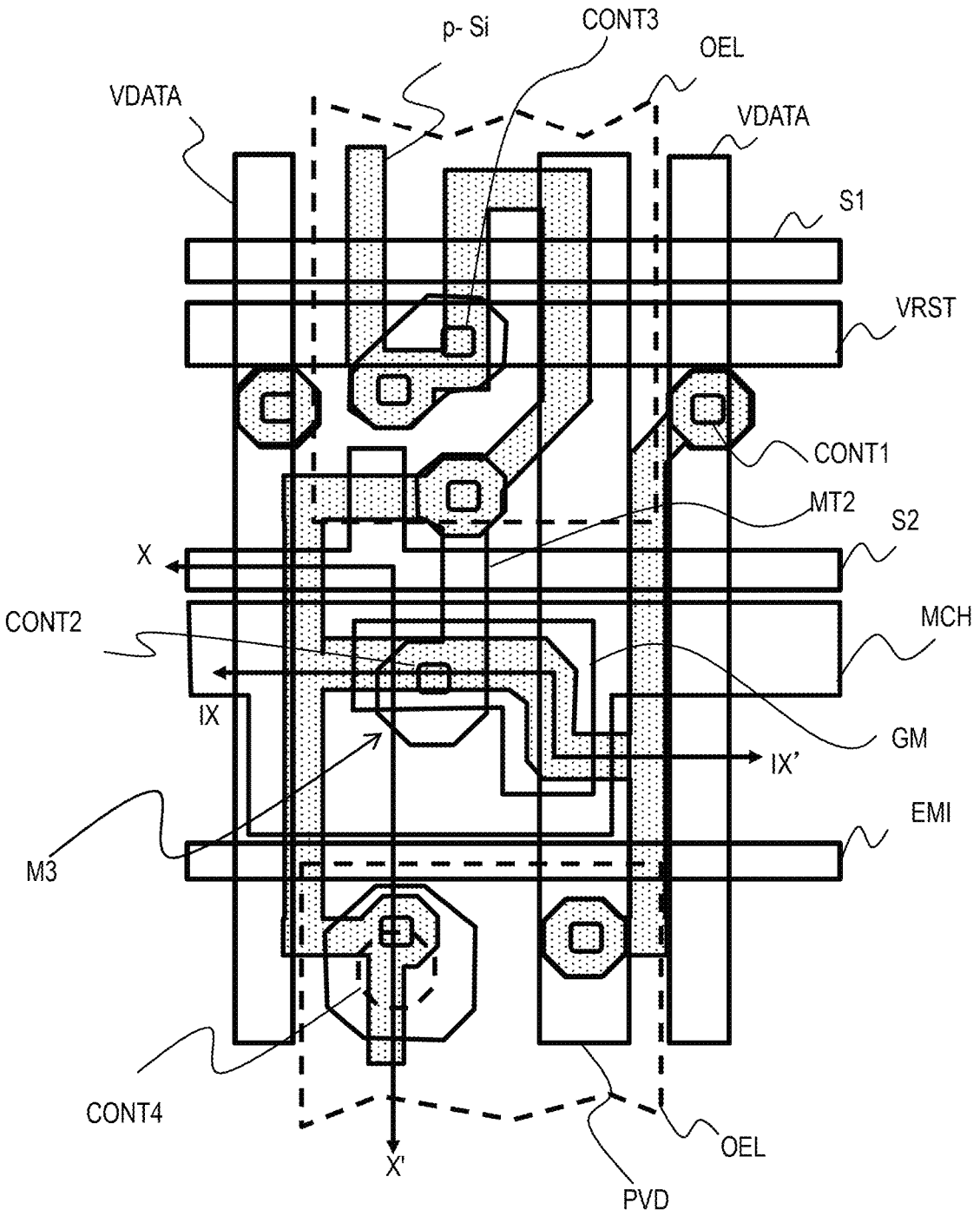
FIG. 8 illustrates a plan view of an example of the device structure of a pixel circuit including a driving transistor.

Hereinafter, an example of the device structure of a pixel circuit including a heating mechanism for the driving transistor is described. FIG. 8 illustrates a plan view of an example of the device structure of a pixel circuit including a driving transistor M3. A part of a poly-silicon film p-Si opposed to the driving transistor M3 corresponds to the channel of the driving transistor M3. The gate electrode GM is connected with a source/drain of a transistor M5 through a contact CONT2 and a metal film MT2. A storage capacitor Cst is configured between the gate electrode GM of the driving transistor M3 and a heater electrode MCH.

FIG. 8 includes organic light-emitting films OEL of two OLED elements. The lower organic light-emitting film OEL in FIG. 8 is the organic light-emitting film of the OLED element to receive driving current from the driving transistor M3. The anode electrode of this OLED element is connected with a metal film through a contact CONT4 and this metal film is connected with the drain of a transistor M6.

FIG. 8 includes two data lines VDATA and one power line PVD extending along the Y-axis. The data line VDATA on the right side transmits the data signal for the driving transistor M3. The data line VDATA on the right side is connected with a source/drain of a transistor M2 through a contact CONT1. The power line PVD supplies driving current to the OLED element via the driving transistor M3.

FIG. 8 includes selection lines S1 and S2, a reset line VRST, and an emission control line EMI extending along the X-axis. The selection line S1 includes the gates of the transistors M5 and M7 and transmits the selection signal S1 to those transistors. The selection line S2 includes the gates of the transistors M2 and M4 and transmits the selection signal S2 to those transistors. The reset line VRST is connected with a source/drain of the transistor M5 through a contact CONT3.

As described above, a storage capacitor Cst is configured between the gate electrode GM and the heater electrode MCH. The heater electrode MCH is wider (longer along the Y-axis) in the part facing the channel and the gate of the driving transistor M3. The heater electrode MCH has wide parts facing the driving transistors M3 in the pixel circuits and narrow parts (which are shorter along the Y-axis) between wide parts. The heater electrode MCH becoming a part of the storage capacitor Cst simplifies the device structure of a pixel circuit.

The heater electrode MCH faces the gate electrode GM and the channel of the driving transistor M3 when viewed planarly. At least a part of the gate electrode GM of the driving transistor M3 and at least a part of the channel of the driving transistor M3 overlap the heater electrode MCH when viewed planarly. In the example of FIG. 8, the entire region of the gate electrode GM and the channel is included in (faces) the region of the heater electrode MCH when viewed planarly. This locational relationship between the heater electrode MCH and the channel enables the channel of the driving transistor M3 to be heated efficiently.

Meanwhile, the heater electrode MCH does not overlap (face) but is separate from the emission region of the OLED element when viewed planarly. In the configuration example of FIG. 8, the heater electrode MCH is separate from the organic light-emitting film OEL when viewed planarly. The emission region is a part of the organic light-emitting film OEL that is in contact with the anode electrode.

The above-described disposition of the heater electrode MCH in the outside of the emission regions of OLED elements when viewed planarly hinders the temperature of the emission regions from rising because of the heat of the heater electrode MCH, achieving less effect on the light emission of the OLED elements.

The unique shape and the unique disposition of the heater electrode MCH make the temperature of the channel of the driving transistor M3 higher than the temperature of the emission region of the OLED element when the heater electrode MCH is radiating heat. The heater electrode MCH selectively heating the channel of the driving transistor M3 prevents the brightness drop of the OLED display device caused by the variation in threshold voltage of the driving transistor, while preventing the heat from affecting the brightness of the OLED element.

In other examples, the heater electrode MCH can be a separate component from the storage capacitor Cst without being shared by one electrode of the storage capacitor Cst. The heater electrode MCH can be separate from the channel region without any overlap when viewed planarly. The heater electrode MCH can overlap (partially face) the emission region of the OLED element when viewed planarly.

Figure 9:
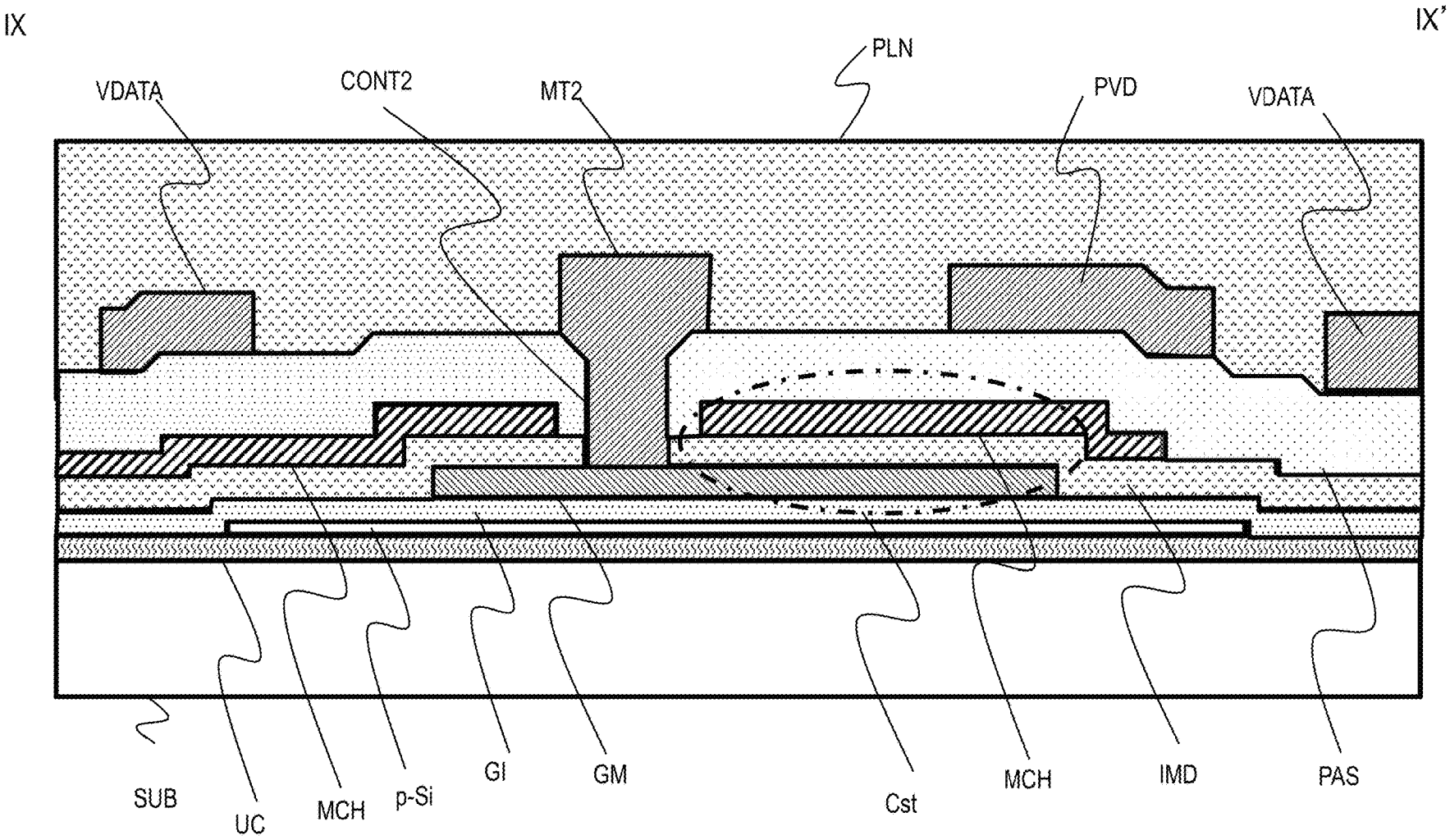
FIG. 9 schematically illustrates a cross-section of the device structure in FIG. 8 along the section line IX-IX'.

FIG. 9 schematically illustrates a cross-section of the device structure in FIG. 8 along the section line IX-IX'. An undercoat film UC is provided on a polyimide substrate SUB. A polysilicon film p-Si is laid above the undercoat film UC. Further, a gate insulating film GI is laid to cover the polysilicon film p-Si. The undercoat film UC and the gate insulating film GI can be inorganic films such as silicon nitride films, silicon oxide films, or laminate of these films.

The gate electrode GM is laid above the gate insulating film GI. The driving transistor M3 in this example has a top-gate structure. However, the heating mechanism in this description is applicable to a pixel circuit including transistors having a bottom-gate structure.

The gate electrode GM is a single layer made of one substance selected from a group consisting of Mo, W, Nb, MoW, MoNb, Al, Nd, Ti, Cu, a Cu alloy, an Al alloy, Ag, and an Ag alloy or a laminate of different substances of these. An inter-metal dielectric film IMD is laid to cover the gate electrode GM. The inter-metal dielectric film IMD can be an inorganic film such as a silicon nitride film, a silicon oxide film, or a laminate of these films.

The heater electrode MCH is laid above the inter-metal dielectric film IMD. A part of the heater electrode MCH faces the gate electrode GM across the inter-metal dielectric film IMD to configure a storage capacitor Cst. The heater electrode MCH can be made of the same material as the gate electrode GM. The heater electrode MCH can be made of a material having higher resistance than the material of the gate electrode GM, such as ITO, to increase the heating efficiency.

A passivation film PAS is laid to cover the heater electrode MCH. The passivation film PAS is an inorganic film such as a silicon nitride film, a silicon oxide film, or a laminate of these films. A contact hole is provided through the passivation film PAS, the heater electrode MCH, and the inter-metal dielectric film IMD, so that a metal film MT2 is in contact with the gate electrode GM. The part inside the contact hole of the metal film MT2 corresponds to the contact CONT2. The metal film MT2 has a structure of Ti/Al/Ti, for example.

A planarization film PLN thereabove is provided to cover the entire element illustrated in FIG. 9. The planarization film PLN can be an organic film.

Figure 10:
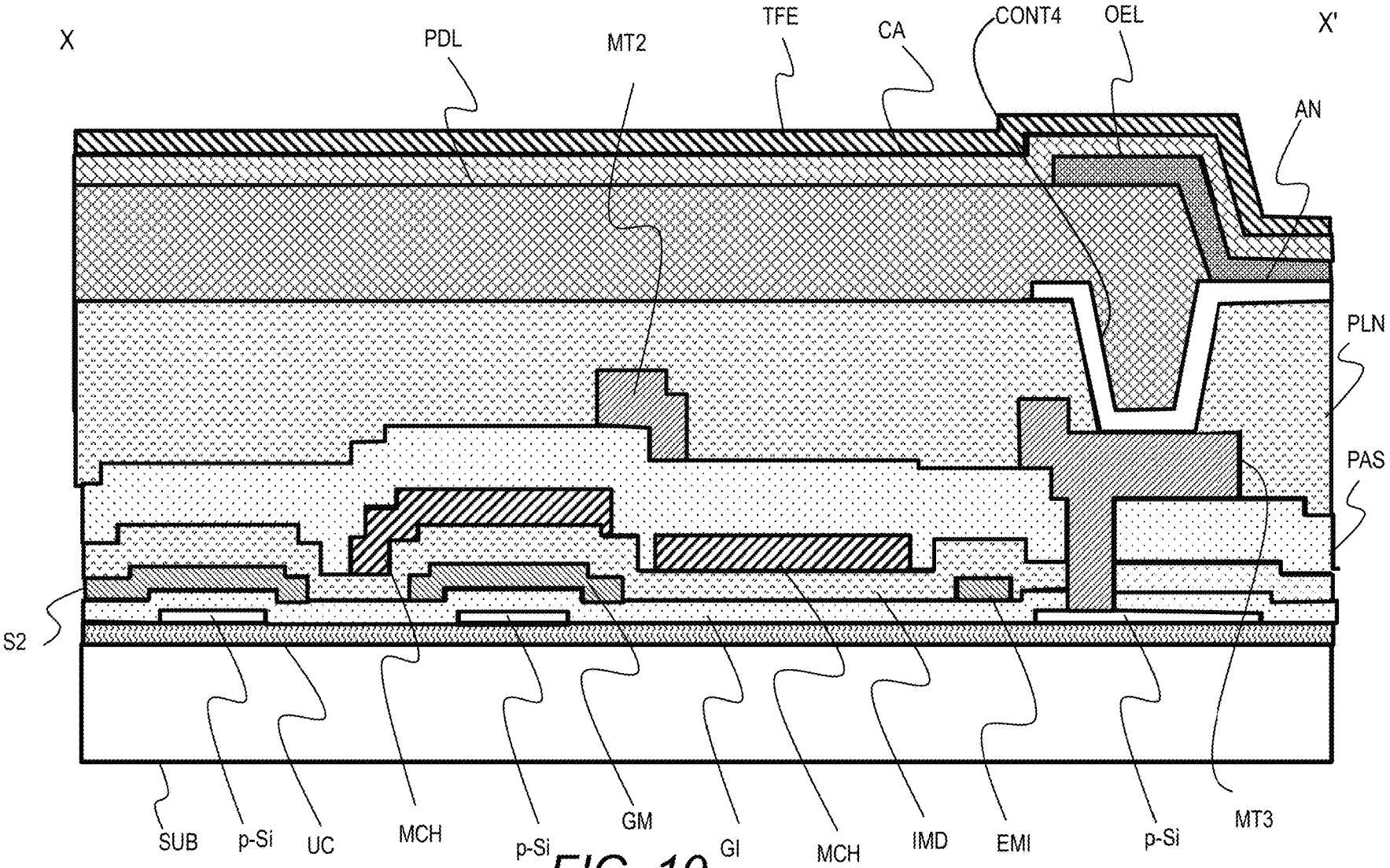
FIG. 10 schematically illustrates a cross-section of the device structure in FIG. 8 along the section line X-X'.

FIG. 10 schematically illustrates a cross-section of the device structure in FIG. 8 along the section line X-X'. The metal layer including the gate electrode GM also includes the selection line S2 and the emission control line EMI. The heater electrode MCH is distant from the organic light-emitting film OEL and the anode electrode AN of the OLED element when viewed planarly (when viewed in the vertical direction in FIG. 10).

The metal layer including the metal film MT2 also includes a metal film MT3 including the contact for connecting the drain (a part of the polysilicon film p-Si) of the transistor M6 and the anode electrode AN. The metal film MT3 is in contact with the contact CONT4, which is included in the same layer as the anode electrode AN and continued to the anode electrode AN. The contact CONT4 is provided in a contact hole formed in the planarization film PLN.

An organic light-emitting film OEL is in contact with the anode electrode AN within a hole provided in the pixel defining layer PDL. The pixel defining layer PDL has holes that define the emission regions (pixels or subpixels) of the OLED elements. The pixel defining layer PDL can be an organic resin film. The anode electrode AN includes three layers of a transparent conductive layer made of ITO, IZO, ZnO, $In_2O_3$, or the like, a reflective layer made of a metal such as Ag, Mg, Al, Pt, Pd, Au, Ni, Nd, Ir, or Cr or an alloy containing such a metal, and another transparent conductive layer as mentioned above. The organic light-emitting film OEL consists of, for example, a hole injection layer, a hole transport layer, a light-emitting layer, an electron transport layer, and an electron injection layer in this order from the bottom. The layered structure of the organic light-emitting film OEL is determined depending on the design.

A cathode electrode CA is provided over the organic light-emitting film OEL. The cathode electrode CA has a shape that fully covers the display region 125. In a top-emission pixel structure, the anode electrode AN has light reflectivity and the cathode electrode CA has light transmissivity. The cathode electrode CA can be made of a metal such as Al or Mg or an alloy thereof, for example.

A thin-film encapsulation TFE is provided above and in contact with the cathode electrode CA. The thin-film encapsulation TFE includes an inorganic insulator (such as SiNx or AlOx) layer, an organic planarization film, and another inorganic insulator (such as SiNx or AlOx) layer from the bottom. The inorganic insulator layer is a passivation layer for increasing the reliability. A $\lambda/4$ plate and a polarizing plate can be laid over the thin-film encapsulation TFE to prevent reflection of the external light.

Figure 11:
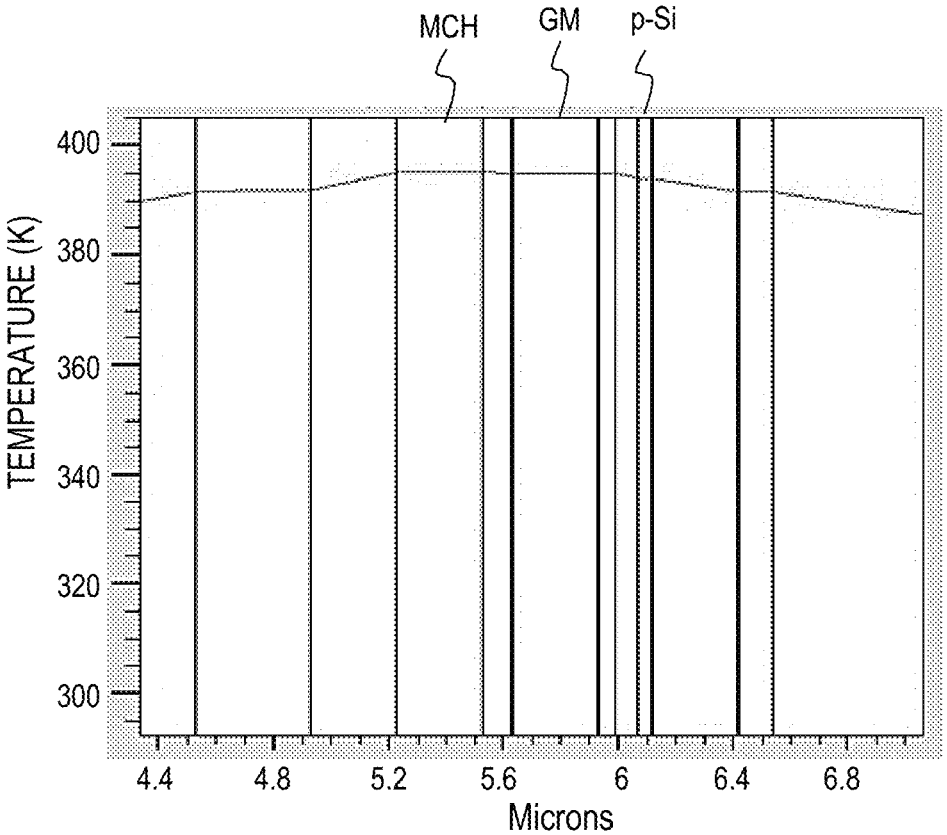
FIG. 11 provides a simulation result on the temperature distribution of a driving transistor in the layering direction when a heater electrode is radiating heat.
Figure 12:
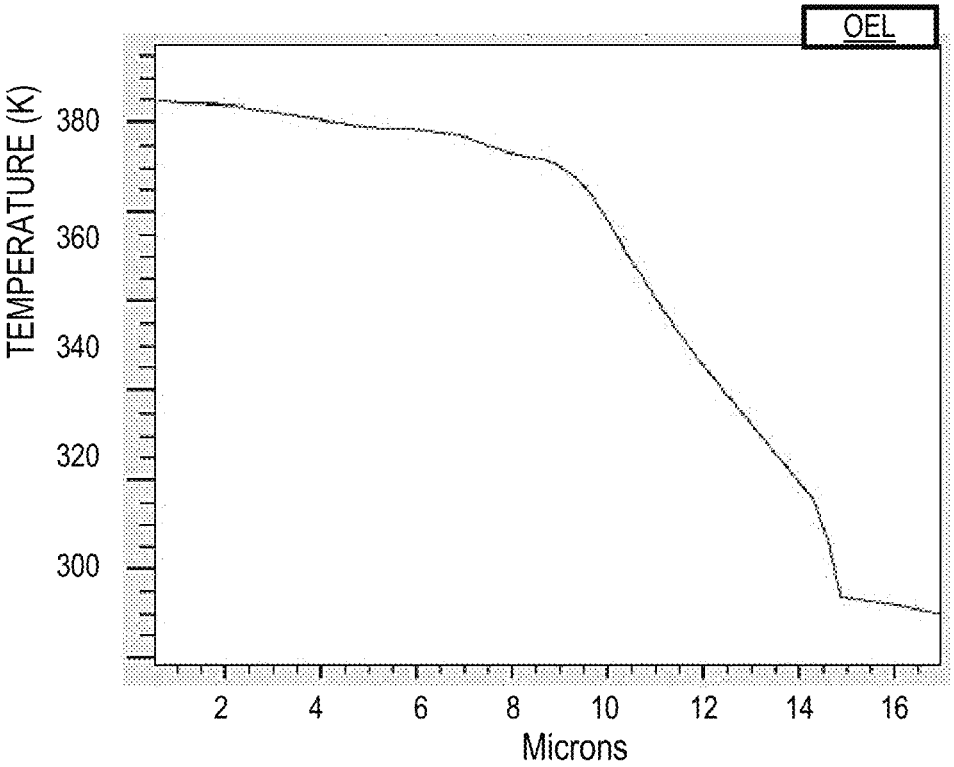
FIG. 12 provides a simulation result on the temperature distribution of a pixel circuit in an in-plane direction when a heater electrode is radiating heat.

FIGS. 11 and 12 provide simulation results on the temperature of a driving transistor and an organic light-emitting film when the heater electrode MCH is radiating heat. FIG. 11 provides the temperature distribution of a driving transistor in the layering direction. In the graph of FIG. 11, the X-axis represents the distance from a point at a specific height in a pixel circuit toward the substrate SUB and the Y-axis represents temperature. In FIG. 11, the ranges corresponding to the heater electrode, the gate electrode, and the channel are denoted by reference signs MCH, GM, and p-Si, respectively. The simulation result in FIG. 11 indicates that the temperatures of the heater electrode, the gate electrode, and the channel are substantially uniform.

FIG. 12 provides the temperature distribution of a pixel circuit in an in-plane direction. The X-axis represents the distance from the middle of the driving transistor toward the organic light-emitting film OEL and the Y-axis represents temperature. The simulation result in FIG. 12 indicates that the temperature at an end of the organic light-emitting film OEL is sufficiently low with respect to the temperature of the thin-film transistor. The heater electrode in this embodiment effectively heats the channel of the driving transistor while preventing the temperature of the emission region from rising.

Heating Control

Hereinafter, heating control methods are described. In an example, the driver IC 134 supplies predetermined potentials to the heating potential supply buses VH1 and VH2 after activation of the display device from a non-displaying state of a power-off state or a stand-by state and keeps applying a constant voltage to the heater electrode MCH. This simple control enables the channel of the driving transistor to be kept at high temperature.

In another example, the driver IC 134 supplies power to the heater electrode MCH in a period (non-light-emitting period) other than the light-emitting period of the OLED element to make the heater electrode MCH radiate heat and stops the supply of power to the heater electrode MCH during the light-emitting period of the OLED element. This control reduces the effect of the heat radiated from the heater electrode MCH on the displayed images.

For example, the driver IC 134 supplies power to all heater electrodes MCH for the period since the OLED display device 10 is activated until the OLED display device 10 starts displaying images. After the supply of power is stopped, power is not supplied to the heater electrodes MCH until the next activation. In another example, the driver IC 134 supplies power to a heater electrode MCH associated with a pixel row in a blanking period between light-emitting periods corresponding to two consecutive frames of the pixel row. When the pixels are emitting light, the supply of power to the associated heater electrode is stopped.

Figure 13:
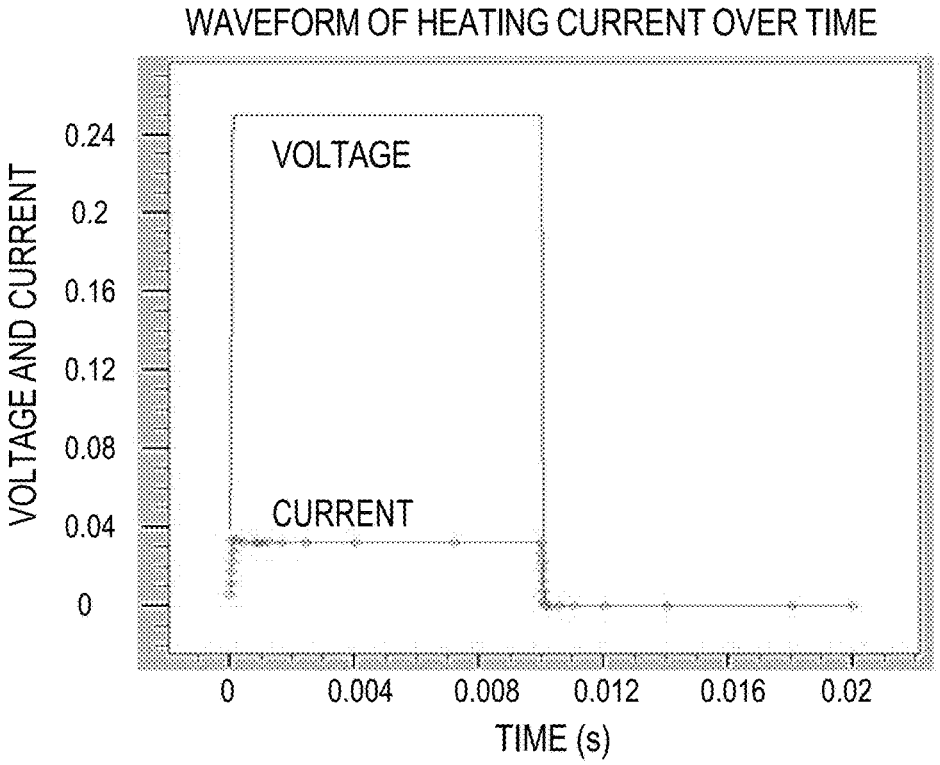
FIG. 13 provides a simulation result on the relation between the heating voltage across the ends of a heater electrode and the heating current flowing through the heater electrode.
Figure 14:
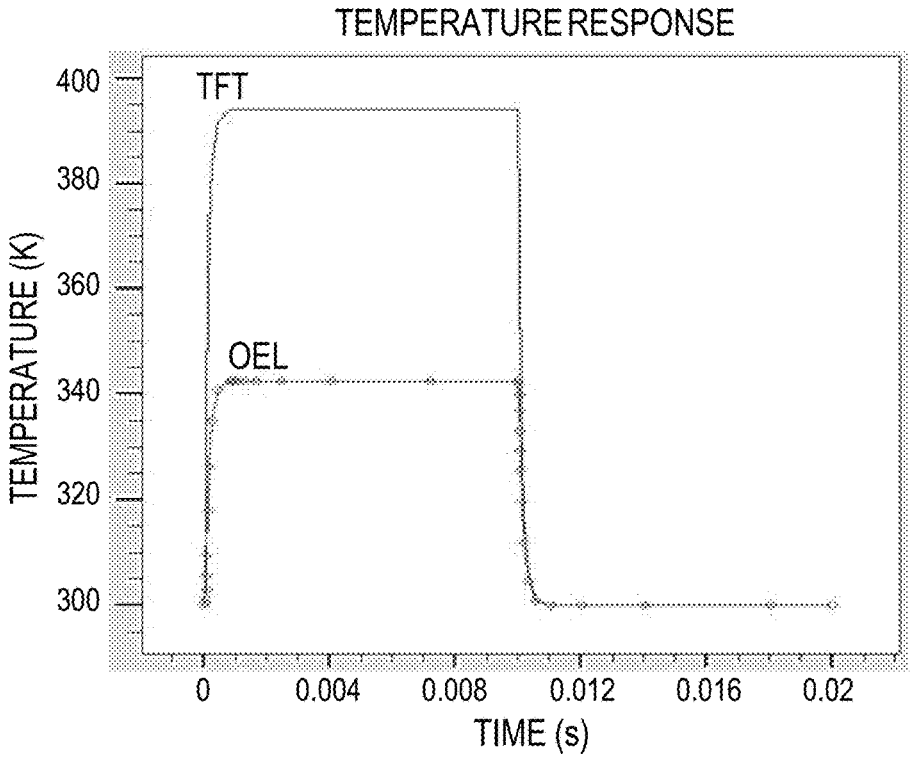
FIG. 14 provides simulation results on the temperature response to the heating voltage shown in FIG. 13 of the channel of a driving transistor and an organic light-emitting film.

FIG. 13 provides a simulation result on the relation between the voltage (heating voltage) across the ends of a heater electrode MCH (the potential difference between buses VH1 and VH2) and the current (heating current) flowing through the heater electrode MCH. The heating current changes immediately in response to change of the heating voltage. FIG. 14 provides simulation results on the temperature response to the heating voltage shown in FIG. 13 of the channel of a driving transistor and an organic light-emitting film OEL. As shown in FIG. 14, the temperature of the channel changes substantially simultaneously with the change of the heating voltage. As understood from the simulation results, the heater electrode MCH can effectively heat the channel of the driving transistor even in a short blanking period.

As set forth above, embodiments of this disclosure have been described; however, this disclosure is not limited to the foregoing embodiments. Those skilled in the art can easily modify, add, or convert each element in the foregoing embodiments within the scope of this disclosure. A part of the configuration of one embodiment can be replaced with a configuration of another embodiment or a configuration of an embodiment can be incorporated into a configuration of another embodiment.

What is claimed is:

1. A display device comprising:

an image display region including a plurality of pixels, each of the plurality of pixels including a light-emitting element and a driving thin-film transistor configured to control an amount of light-emitting current to the light-emitting element;

a pair of external terminals disposed outside the image display region and provided with different potentials;

a current supply electrode disposed in the image display region for supplying the light-emitting current through the driving thin-film transistor to the light-emitting element; and a heater electrode supplied with heating current from the pair of external terminals to generate heat, the heating current being different from the light-emitting current with no heating current being supplied to the light-emitting element and a channel of the driving thin-film transistor, wherein a temperature of a channel of the driving thin-film transistor is higher than a temperature of an emission region of the light-emitting element when the heater electrode is generating heat.

2. The display device according to claim 1, wherein at least a part of the channel of the thin-film transistor overlaps the heater electrode when viewed planarly.

3. The display device according to claim 1, wherein at least a part of the heater electrode faces a gate electrode of the driving thin-film transistor across an insulator to be a part of a storage capacitor that determines a potential of the gate electrode.

4. The display device according to claim 1, wherein the heater electrode is disposed outside the emission region of the light-emitting element when viewed planarly.

5. The display device according to claim 1, wherein an entire region of the channel of the driving thin-film transistor is included in a region of the heater electrode when viewed planarly.

6. The display device according to claim 1, further comprising:

pixel circuits for the plurality of light-emitting elements;

a control circuit configured to control the pixel circuits;

a first bus and a second bus disposed to sandwich the display region; and a plurality of heater electrodes including the heater electrode, wherein each of the two buses is connected with the control circuit via a connection pad, and wherein each of the plurality of heater electrodes extends within the display region and a first end of each heater electrode is connected with the first bus and an opposite, second end of each heater electrode is connected with the second bus.

7. The display device according to claim 1, wherein the temperature of the channel of the driving thin-film transistor is 80° C. or higher and the temperature of the emission region of the light-emitting element is 70° C. or lower when the heater electrode is generating heat.

8. The display device according to claim 1, wherein the heater electrode is supplied with the heating current in a period other than a light emitting period of the light-emitting element.

9. A display device comprising:

an image display region including a plurality of pixels, each of the plurality of pixels including a light-emitting element and a driving thin-film transistor configured to control an amount of light-emitting current to the light-emitting element;

a pair of external terminals disposed outside the image display region and provided with different potentials;

a current supply electrode disposed in the image display region for supplying the light-emitting current through the driving thin-film transistor to the light-emitting element; and a heater electrode supplied with heating current from the pair of external terminals to generate heat, the heating current being different from the light-emitting current with no heating current being supplied to the light-emitting element and a channel of the driving thin-film transistor, wherein at least a part of the heater electrode faces a gate electrode of the driving thin-film transistor across an insulator to function as a part of a storage capacitor that determines a potential of the gate electrode, and wherein at least a part of a channel of the driving thin-film transistor overlaps the heater electrode when viewed planarly and the light-emitting element is separated from the heater electrode so that the light-emitting element does not overlap the heater electrode when viewed planarly.

10. The display device according to claim 9, wherein a temperature of the channel of the driving thin-film transistor is higher than a temperature of an emission region of the light-emitting element when the heater electrode is generating heat.

11. The display device according to claim 9, wherein the heater electrode is disposed outside an emission region of the light-emitting element when viewed planarly.

12. The display device according to claim 9, wherein an entire region of the channel of the driving thin-film transistor is included in a region of the heater electrode when viewed planarly.

13. The display device according to claim 9, further comprising:

pixel circuits for the plurality of light-emitting elements;

a control circuit configured to control the pixel circuits;

a first bus and a second bus disposed to sandwich the display region; and a plurality of heater electrodes including the heater electrode, wherein each of the two buses is connected with the control circuit via a connection pad, and wherein each of the plurality of heater electrodes extends within the display region and a first end of each heater electrode is connected with the first bus and an opposite, second end of each heater electrode is connected with the second bus.

14. The display device according to claim 9, wherein a temperature of the channel of the driving thin-film transistor is 80° C. or higher and a temperature of the emission region of the light-emitting element is 70° C. or lower when the heater electrode is generating heat.

15. The display device according to claim 9, wherein the heater electrode is supplied with the heating current in a period other than a light emitting period of the light-emitting element.

16. A display device according to claim 1 further comprising a resin film on which the image display region and the pair of external terminals are formed.

17. A display device according to claim 9 further comprising a resin film on which the image display region and the pair of external terminals are formed.

* * * * *